United States Patent [19]

Cibor

[11] Patent Number: 4,999,544

[45] Date of Patent: Mar. 12, 1991

[54] TREE HUNG ORNAMENTAL DIMMER

[76] Inventor: Michael K. Cibor, 1027 Highland, Lincoln Park, Mich. 48146

[21] Appl. No.: 345,308

[22] Filed: May 1, 1989

[51] Int. Cl.[5] ..... H05B 37/00

[52] U.S. Cl. ..... 315/185 S; 362/806

[58] Field of Search ..... 315/185 S, 291, 200 R, 315/DIG. 4; 362/806

[56] References Cited

U.S. PATENT DOCUMENTS 2,509,809 5/1950 Cook ..... 362/806 X

*Primary Examiner*—Robert J. Pascal

*Attorney, Agent, or Firm*—John R. Benefiel

[57] ABSTRACT

A dimmer device adapted to enable conveniently accessed control over the intensity of illumination of Christmas tree lights, in which a housing for the dimmeter device is enclosed in a housing on ornamental cover piece, and which is provided with a hook to allow the device to hang on a branch in an exposed position.

2 Claims, 1 Drawing Sheet

TREE HUNG ORNAMENTAL DIMMER

This invention concerns Christmas tree lights and more particularly a control arrangement for allowing selective control over the intensity of illumination provided by such lights.

It is desirable sometimes to lessen the intensity of the electric lights used to decorate Christmas trees. For high wattage decorative bulbs, power loads of 1000 watts or more are not uncommon. The amount of heat generated is considerable, tending to dry out the tree and the bulbs themselves present a burn or fire hazard. While the use of dimmer controls is well known for selectively varying the power applied to incandescent lights to vary the intensity of illumination, such dimmer devices have not been conveniently usable for special application to Christmas tree lights.

The reduction in heat would allow the tree to be illuminated for extended periods without drying of the tree or consuming excessive amounts of power, and eliminating the hazard of injury or fire.

The object of the present invention is to provide an arrangement for enabling selective control over Christmas tree ornamental lights.

SUMMARY OF THE INVENTION

This and other objects of the present invention will become apparent upon a reading of the following specification and claims are achieved by an ornament comprised of a dimmer device plugged into an electrical outlet by means of an extension cord, and into which the tree lights are plugged. The dimmer ornament is adapted to be hung on the tree in an exposed location at a convenient height, and this position enables the dimmer control knob to be easily and conveniently accessible when adjusting the intensity level of the lights as desired.

DETAILED DESCRIPTION

In the following specification, specific terminology is employed for the sake of clarity, and a particular embodiment will be described in accordance with the requirements of 35 USC 112 but it should be understood that this is not intended to be limiting inasmuch as the invention is capable of taking many forms and variations within the scope of the appended claims.

Figure 1:
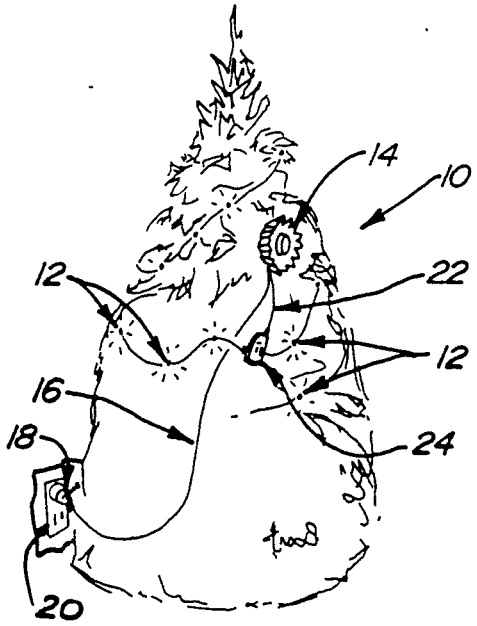
FIG. 1 is a perspective view of a decorated Christmas tree, with a dimmer ornament according to the present invention.
Figure 2:
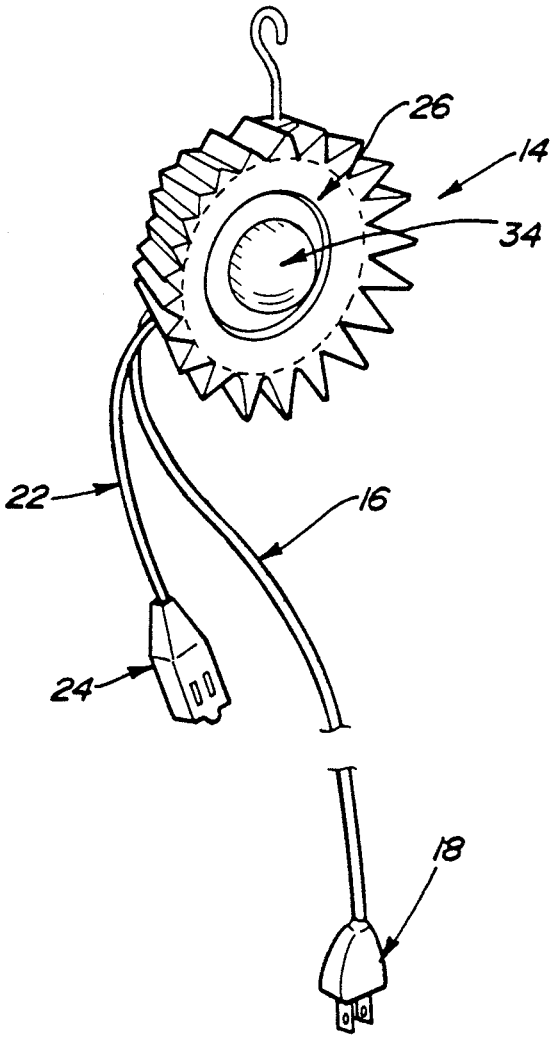
FIG. 2 is a perspective view of the dimmer ornament and extension power cords according to the present invention.
Figure 3:
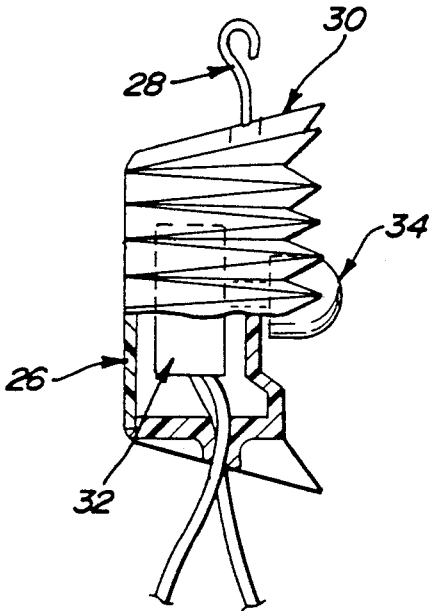
FIG. 3 is a partially sectional side view of the dimmer ornament shown in FIG. 2.

FIG. 1 illustrates a Christmas tree 10 on which one or more strings of electric lights 12 have been strung. According to the concept of the present invention, an ornamental dimmer device 14 is also hung on the tree 10. The ornamental dimmer device 14 includes a first extension power cord 16 having a male plug 18 adapted to be inserted in a power outlet 20.

A second extension power cord 22 having a female plug 14 in turn enables strings of Christmas tree lights to be powered via the dimmer ornament device 14.

The dimmer ornament device 14 includes a housing 26 adapted to be hung by means of a hook 28, and covered by an ornamental trim piece, such as a pleated star design 30.

The housing 26 is preferably of a suitable, molded green colored plastic, and contains a conventional electronic dimmer device 32, of a type commercially available, which includes a movable control element comprised of a rotary knob 34 located centered at the front of the housing 26, within the decorative trim piece 30. Rotation of the knob 34 causes a reduction or increase in the voltage and thus the power applied to the second extension power cord 22, depending on the direction of rotation, to enable a reduction over that applied from a direct connection to household current.

Accordingly, the device 14 can be hung at a convenient height and at a convenient location on the Christmas tree 10 to enable ready access for making adjustments in the intensity of the Christmas tree lights 12. The appearance of the dimmer ornament device is such as to not mar the aesthetic effect of the other ornamentation while being exposed at a location enabling ready access for making adjustments.

I claim:

1. A device for use in controlling the intensity of Christmas tree lights comprising:

a housing;

an electronic dimmer means mounted in said housing;

a first extension power cord connected to said dimmer device and having a male plug adapted to be plugged into a power outlet;

a second extension power cord connected to said dimmer device and having a female plug adapted to have Christmas tree lights to be plugged thereto;

said dimmer means including a movable element, and means enabling a reduction in the voltage applied from said power outlet to said second extension power cord, selectively controlled by movement of said element;

hanger means for said housing enabling hanging said device on a Christmas tree branch; and;

an ornamental cover piece covering said dimmer housing compatible with Christmas ornamentation, whereby said housing may be hung in a Christmas tree in an exposed position to enable ready access thereto for making power adjustments.

2. The device according to claim 1 wherein said dimmer element comprises a rotary knob centered within said ornamental covering piece.

* * * * *